US005879176A

United States Patent [19]

Stimson

[11] Patent Number: 5,879,176

[45] Date of Patent: Mar. 9, 1999

[54] INTERLOCKED CONNECTOR

[75] Inventor: Bradley O. Stimson, San Jose, Calif.

[73] Assignee: Applied Materials, Inc., Santa Clara, Calif.

[21] Appl. No.: 797,072

[22] Filed: Feb. 10, 1997

[51] Int. Cl.[6] ..... H01R 29/00

[52] U.S. Cl. ..... 439/188; 200/51.09

[58] Field of Search ..... 439/188, 944, 439/490; 200/51.1 R, 51.09

[56] References Cited

U.S. PATENT DOCUMENTS 3,598,941 8/1971 Nelson ..... 200/51.09
3,912,889 10/1975 Bright ..... 439/944
4,099,825 7/1978 Jackson ..... 439/188
4,575,694 3/1986 Lapke et al. ..... 439/944
4,658,212 4/1987 Ozawa et al. ..... 439/188

*Primary Examiner*—Khiem Nguyen
*Assistant Examiner*—Eugene G. Byrd
*Attorney, Agent, or Firm*—Patterson & Associates

[57] ABSTRACT

An interlocked connector having integral interlock components such as a spring biased pin in a female connector which actuates an interlocked switch whenever the female connector is mated with a male connector. The interlocked switch interrupts a power source to avoid a dangling live connector.

20 Claims, 7 Drawing Sheets

INTERLOCKED CONNECTOR

FIELD OF THE INVENTION

The present invention relates to connectors for coupling a power source to a device. More specifically, the invention relates to interlocked connectors which must be coupled between a device and a power source in order to activate the power source.

BACKGROUND OF THE RELATED ART

Connecting a power source, such as a radio frequency ("RF") power source, to a device, such as an RF match unit, can be hazardous if the connecting cable can be disengaged at the device while still attached, at the other end, to the power source, resulting in an open live cable end. To avoid this hazard, the cable may be configured so as not to provide a disconnection at the device, thus allowing the connecting cable to be disengaged at the power source. However, in industrial applications, cables are commonly not supplied with equipment. Rather, the equipment includes standard connection jacks for receipt of industry standard cables.

One known solution to having a live open end on a connecting cable typically involves an interlocked switch provided between the cable and device. The interlocked switch disables a power source when the connecting cable is disengaged at the device. Interlocked switches typically include two bulky housings which enclose a male/female connection and a microswitch that is actuated by mating the housings around the male/female connection. The microswitch is in turn connected by a control wire to control circuits that switch the power source off when the male/female connection is disengaged. Unfortunately, some of the interlocked switches rely heavily on the integrity of equipment operators since the housings can be mated and activate a power source without enclosing the male/female connection. The incentive to bypass an interlocked switch arises when the interlocked components are time consuming to use properly.

FIG. 1 (Prior Art) shows such an interlocked switch assembly for disabling an A/C power source 10 which powers a semiconductor processing platform 12 which typically includes two or more high vacuum chambers 14, 16. Each chamber 14, 16 typically receives RF power through an RF match unit 18, 20 from an RF source 22, 24 which employs A/C power. The RF sources 22, 24 are connected to the RF match units 18, 20 by flexible RF cables 26, 28 having male connectors on each end. Connection of each RF cable 26, 28 at the RF match unit 18, 20 presents the possibility of a dangling live male connector. Each chamber 14, 16 typically has an independently powered interlock circuit 30, 31 which is disabled by an interlock switch string 32, 33 unless an interlocked switch 34, 36 is closed to establish a completed male/female RF connection at the RF match unit 18, 20.

FIG. 2 (Prior Art) shows an interlocked switch 34 positioned to be closed after a male RF connector 42 on the RF cable 26 and a female RF connector 44 on the RF match unit 18 are mated to supply RF power to the RF match unit. The interlocked switch 34 is closed by joining a first housing 46 and a second housing 48 around the RF connection.

FIG. 3 (Prior Art) is a schematic circuit diagram for the interlocked switch assembly of FIG. 1. The independently powered interlock circuit 30 includes a battery 50, a contactor 52 which interrupts power to the chamber 14 from the A/C power source 10, and a relay 54 which is closed by a current in the interlock switch string 32. The interlock switch string 32 includes the relay 54 and further includes a separate power source 56, the interlocked switch 34 which interlocks the RF match unit 18, and one or more additional switches 58, 59 which interlock other components with the A/C power source 10 to the chamber 14.

There is a need for a passive interlocked switch for use with connecting cables which connect a device to a power source wherein the interlocked switch does not require separate action by an operator to connect or disconnect the interlocked switch when replacing the connecting cable. It would be desirable if the interlocked switch was not easily bypassed.

SUMMARY OF THE INVENTION

The present invention provides an interlocked connector for connecting a power source to a device. The interlocked connector has integral interlock components for actuating a microswitch which activates the power source. A female interlocked connector comprises one or more integral pins biased in a retracted position within a connector body, and an integral actuator positioned between the integral pin and a receiving chamber to move the integral pin to an extended position in response to insertion of a male connector into the receiving chamber. The integral pin actuates a microswitch which is preferably mounted within the device to further inhibit bypassing of the interlocked connector.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings. The appended drawings illustrate typical embodiments of this invention and are not to be considered limiting of its scope, for the invention may admit to other equally effective embodiments.

DETAILED DESCRIPTION OF THE INVENTION

Figure 1:
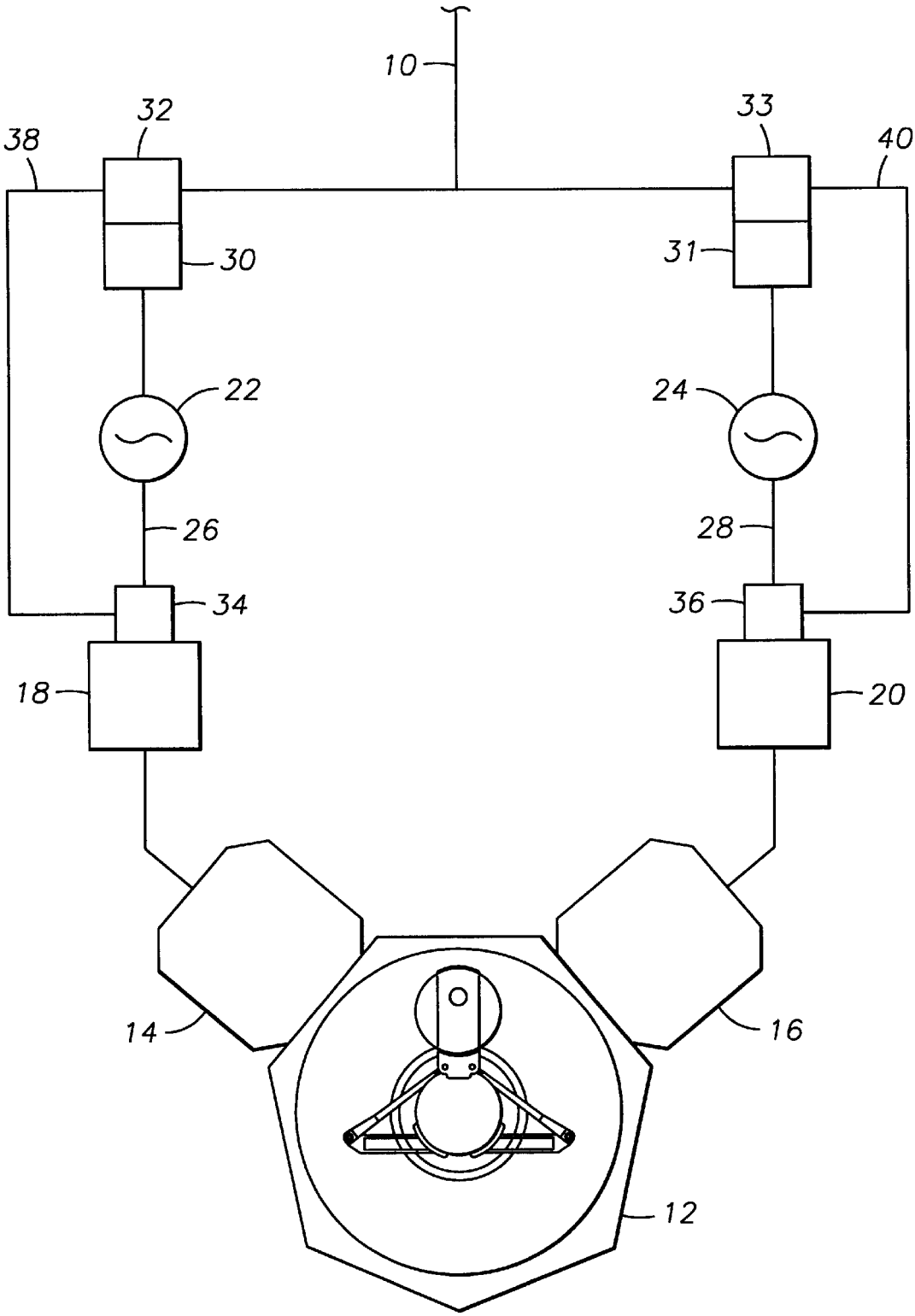
FIG. 1 (PRIOR ART)
FIG. 1 (prior art) is a schematic view of a wafer processing platform having interlocked switches which disable RF power to a vacuum chamber when an RF cable is not properly connected to a RF match unit.
Figure 2:
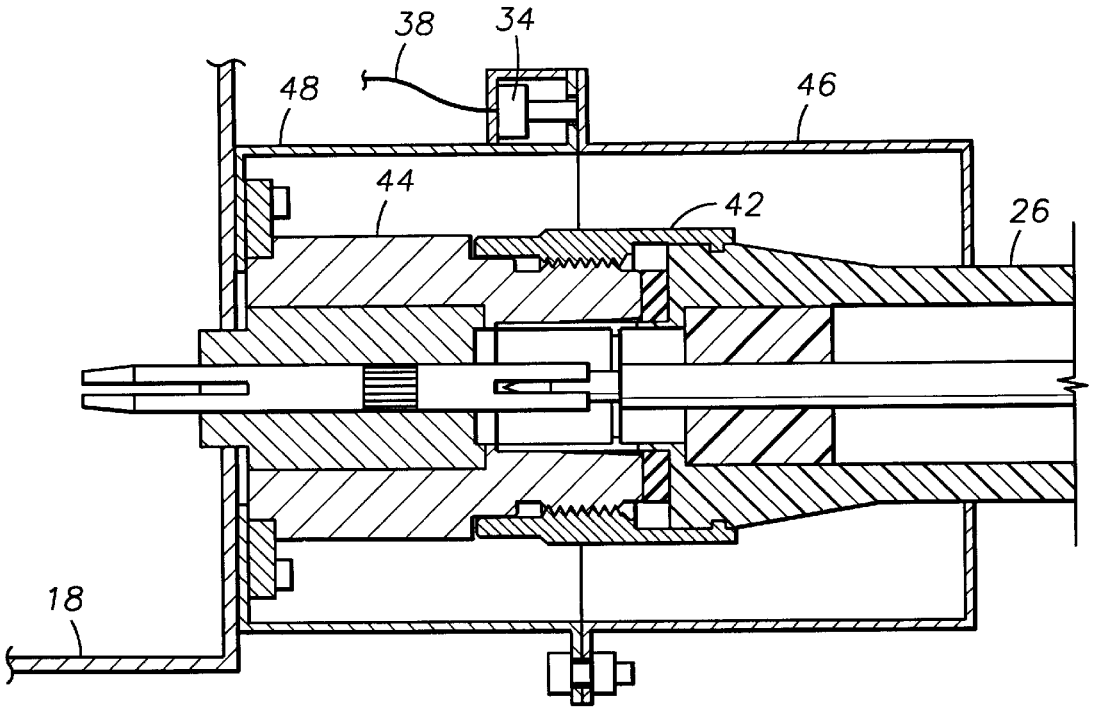
FIG. 2 (PRIOR ART)
FIG. 2 (prior art) is a schematic view of an interlocked switch which has been used as shown in FIG. 1.

The present invention provides an interlocked connector comprising integral interlock components for activating an interlocked switch. While the interlocked connector may be either a male or a female connector, it is preferred that the integral interlock components be concealed from casual contact or easy tampering by placement within a female connector. Accordingly, the present invention preferably provides a female interlocked connector, comprising a connector body having a receiving chamber, one or more integral pins biased in a retracted position within the connector body, and an integral actuator positioned between the integral pin and the receiving chamber to move the integral pin to an extended position in response to insertion of a male connector into the receiving chamber.

The interlocked connector is preferably mounted on a base plate of a device which is powered by an external power source. In addition to the interlocked connector, the device preferably encloses an internal microswitch and a switch actuator positioned to depress the microswitch when the switch actuator contacts the integral pin in the extended position. The integral pin is extended by inserting a male connector on a connecting cable into the receiving chamber of the female connector. Disconnection of the interlocked connector disables the power source and avoids a dangling live connecting cable.

The interlocked connectors safely connect a power source, including AC sources, DC sources, and RF sources, to devices wherein power passes through a connecting cable. Examples of devices which can use the interlocked connectors include dynamic components in silicon wafer processing platforms such as vacuum pumps, processing chambers and RF match units. Each dynamic component of the processing platform preferably has an interlocked switch which activates a power source for the component. Most preferably, each interlocked switch activates all power to a vacuum chamber by activating a common AC power supply. Thus, disconnection of one connecting power cable on the processing platform interrupts all AC power to one of the vacuum chambers.

Each interlocked connector on an integrated apparatus, such as the silicon wafer processing platform, may have a unique size or configuration to prevent any hazards from cross-connection of power sources and devices. For example, the processing platform may have two or more RF match units and two or more RF power sources for operating two or more vacuum chambers. Cross-connection of the RF match units and the RF power sources typically causes an error in process control which shuts down the processing platform. Cross-connection of the RF power sources is avoided by using different interlocked connectors on adjacent RF power cables such that both chambers do not operate until the connecting cables join each RF power source to the correct RF match unit.

The interlocked connector of the present invention may be used to connect a device, such as the RF match unit, to another device, such as the processing chamber, since the problem of a dangling live connecting cable arises for all connecting cables which join additional devices in series or in parallel to the power source, such as the RF power source.

The invention is further described by reference to specific RF connectors shown in the drawings. The RF connectors transmit RF power through a contact core surrounded by an insulator casing. However, the interlock components of the specific connectors are readily transferred to other RF connectors or connectors for other power sources.

Figure 4:
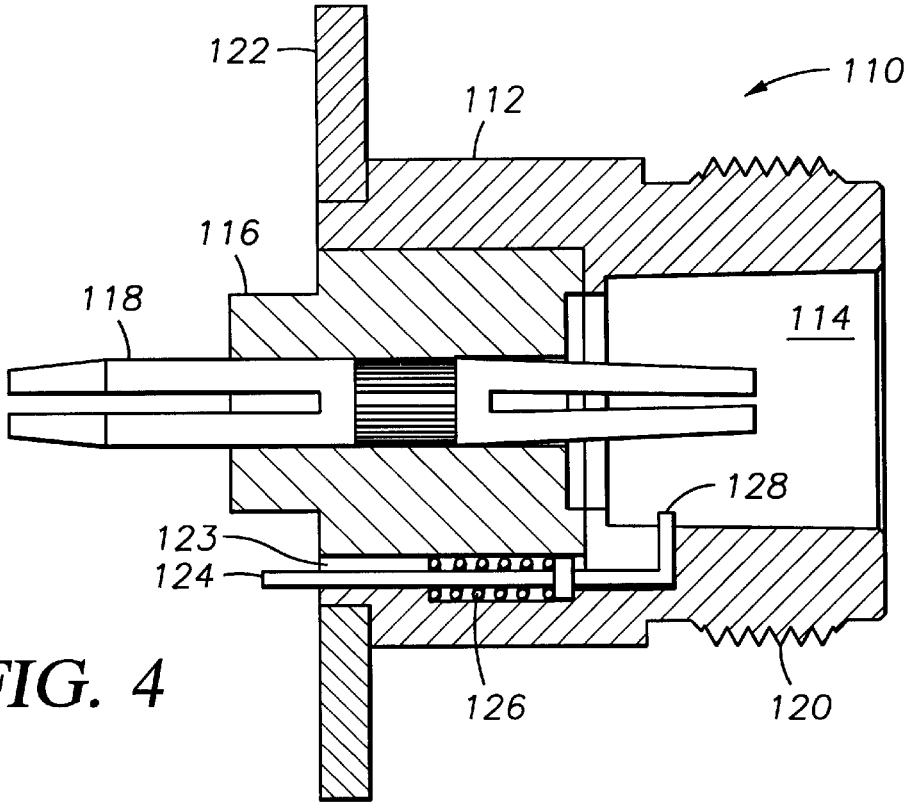
FIG. 4 is a cross-sectional view of a female interlocked connector having integral interlock components for actuating an interlocked switch when joined with a male connector.

FIG. 4 is a cross-sectional view of a female interlocked connector 110 having integral interlock components for actuating an interlocked switch when joined with a male connector. The female interlocked connector 110 comprises a metallic connector body 112 having a receiving chamber 114 for receiving a male connector. The connector body 112 houses a polymeric insulator casing 116 and a metallic contact core 118 which transmits RF power. The contact core 118 may have any configuration for completing a circuit, such as a slotted pin, a solder cup, a microstrip, or the like. The connector body 112 has external threads 120 for securing the male connector into the receiving chamber 114. The connector body 112 is fixed to a flange 122 for mounting the female interlocked connector 110 on a rigid plate of a device, such as a housing for an RF match unit or a silicon wafer processing chamber.

The connector body 112 of the interlocked connector 110 has a machined slot 123 for receiving an integral pin 124 which is biased in a retracted position by a spring 126. The retracted position can leave a portion of the integral pin 124 exposed outside the connector body 112 as shown, or the integral pin 124 can be fully retracted within the connector body 112 as shown in an alternative embodiment which is described below. A bent tip 128 on the integral pin 124 extends into the receiving chamber 114. Insertion of a male connector into the receiving chamber 114 pushes on the bent tip 128 of the integral pin 124 causing compression of the spring 126 and extension of the integral pin 124 into the device. When extended, the integral pin 124 can engage a microswitch which controls AC power to an RF power source that supplies RF power to an RF device, such as an RF match unit. Preferably, the microswitch is mounted within the device where it is not readily bypassed as described for the alternative embodiment described below.

Figure 5:
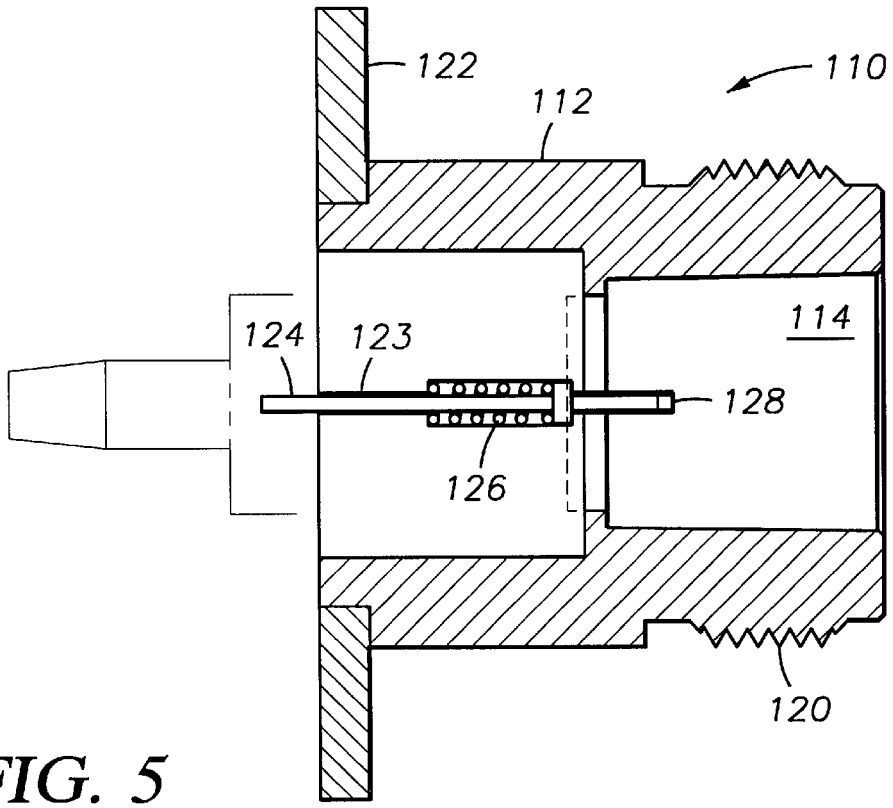
FIG. 5 is a cross-sectional view of the female interlocked connector of FIG. 4 having several internal components removed to show additional details of the integral interlocked components.

FIG. 5 is a cross-sectional view of the female interlocked connector of FIG. 4 having several internal components removed to show additional details of the integral interlock components. As shown in FIG. 5, the integral pin 124 and the spring 126 are readily inserted in the machined slot 123 in the connector body 112 when the polymeric insulator casing 116 and the contact core 118 are removed from the connector body 112. The insulator casing 116 assists in retaining the spring 126 within the machined slot 123 and the spring retains the integral pin 124 within the machined slot 123. The machined slot 123 is preferably cut into a conventional connector.

Figure 6:
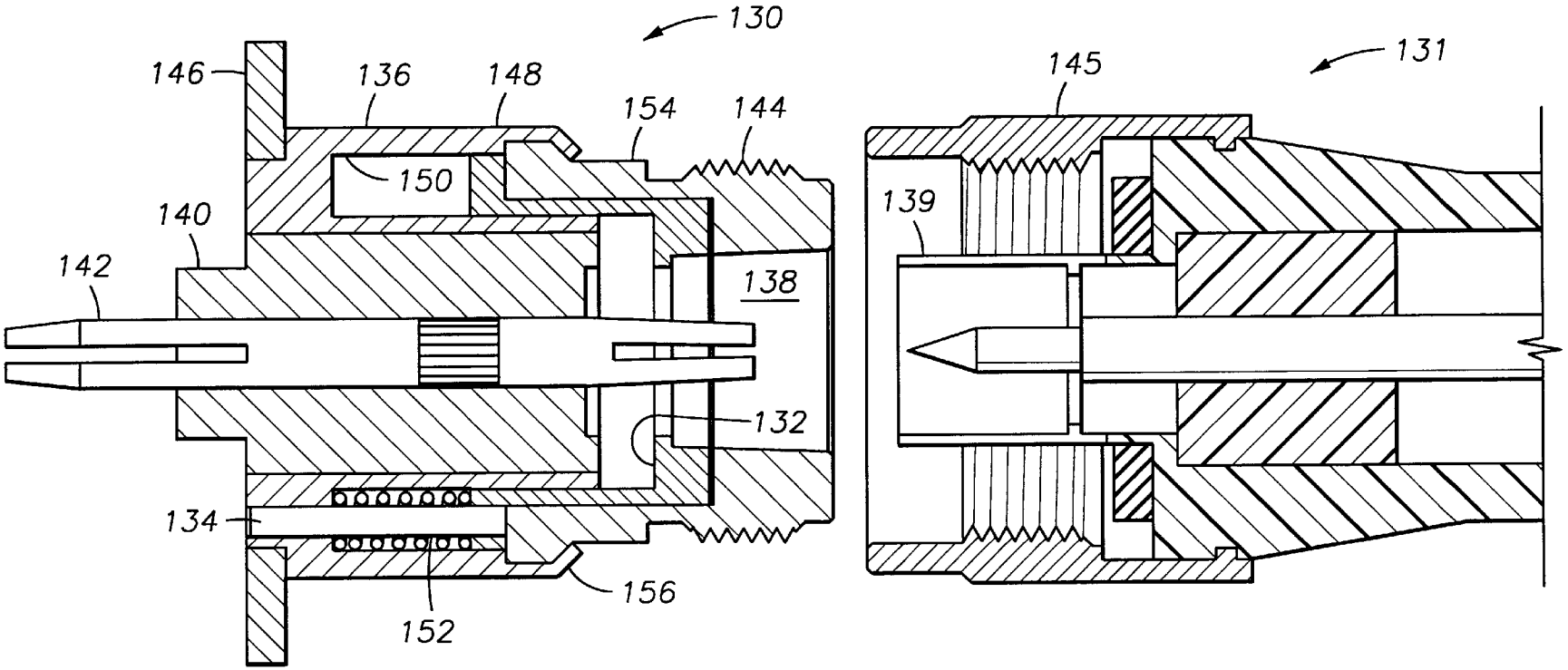
FIG. 6 is a cross-sectional view of an alternative female interlocked connector having alternative integral interlock components for actuating an interlocked switch when joined with a male connector.

A preferred female interlocked connector 130 is shown in FIGS. 6–9. FIG. 6 is a cross-sectional view of the female interlocked connector 130 having alternative integral interlock components for actuating an interlocked switch when joined with a male connector 131. The preferred female interlocked connector 130 performs the same function as the female interlocked connector 110 shown in FIGS. 4 and 5 using a cylindrical plunger 132 to actuate one or more integral pins 134 instead of a bent tip 128 on the pin 124. The female interlocked connector 130 comprises a metallic connector body 136, preferably made of brass, having a receiving chamber 138 for receiving an end 139 of the male connector 131. The connector body 136 houses an insulator casing 140, preferably made from a fluorocarbon polymer such as a polytetrafluoroethylene (PTFE) or a fluorinated ethylene/propylene polymer (FEP). The insulator casing 140 shields a metallic contact core 142, preferably made of a beryllium/copper alloy, which transmits RF power. The contact core 142 may have any configuration for completing a circuit, such as a slotted pin, a solder cup, a microstrip, or the like. The connector body 136 has external threads 144 for securing a rotating nut 145 on the male connector 131. The connector body 136 is fixed to a flange 146 for mounting the female interlocked connector 130 on a rigid plate such as a housing for an RF match unit or a silicon wafer processing chamber. The connector body 136 has two sections which assist in assembling the interlocked connector as described for FIG. 8 below. A first section 148 of the connector body 136 is fixed to the flange 146 and has an annular channel 150 for receiving the cylindrical plunger 132 which secures the integral pins 134. Each integral pin 134 is biased by a spring 152 which holds the integral pins 134 in a retracted position as shown in FIG. 6. A second section 154 of the connector body 136 holds the cylindrical plunger 132 in the annular channel 150 in the first section 148 and is secured by pressing or crimping an edge 156 of the first section 148 against the second section 154.

Figure 7:
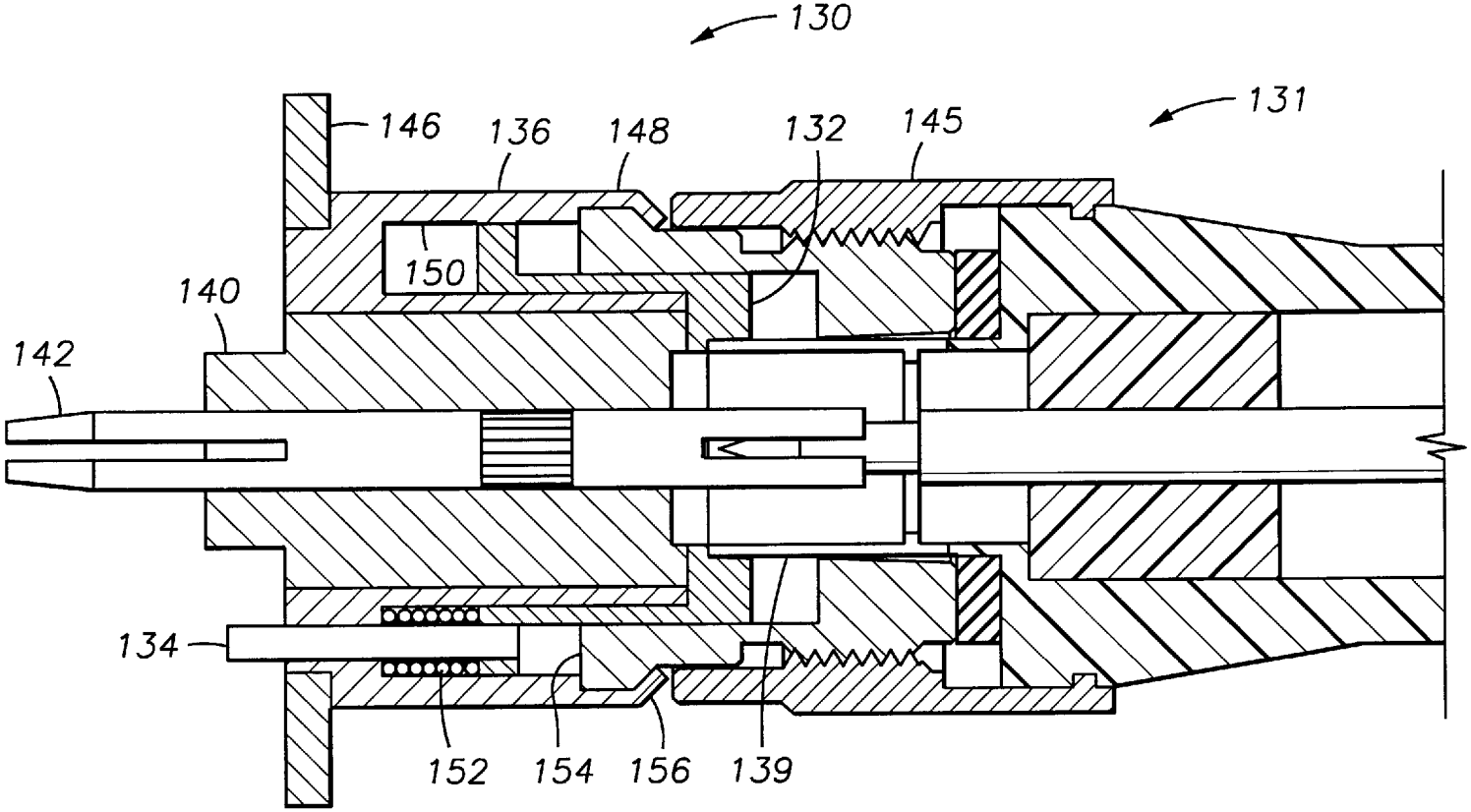
FIG. 7 is a cross-sectional view of the female interlocked connector of FIG. 6 showing movement of the integral components when joined to the male connector.

FIG. 7 is a cross-sectional view of the female interlocked connector 130 of FIG. 6 showing movement of the integral components when joined to the male connector 131. The male connector 131 depresses the cylindrical plunger 132 which compresses the springs 152 and moves the integral pins 134 to the extended position shown in FIG. 7.

Figure 8:
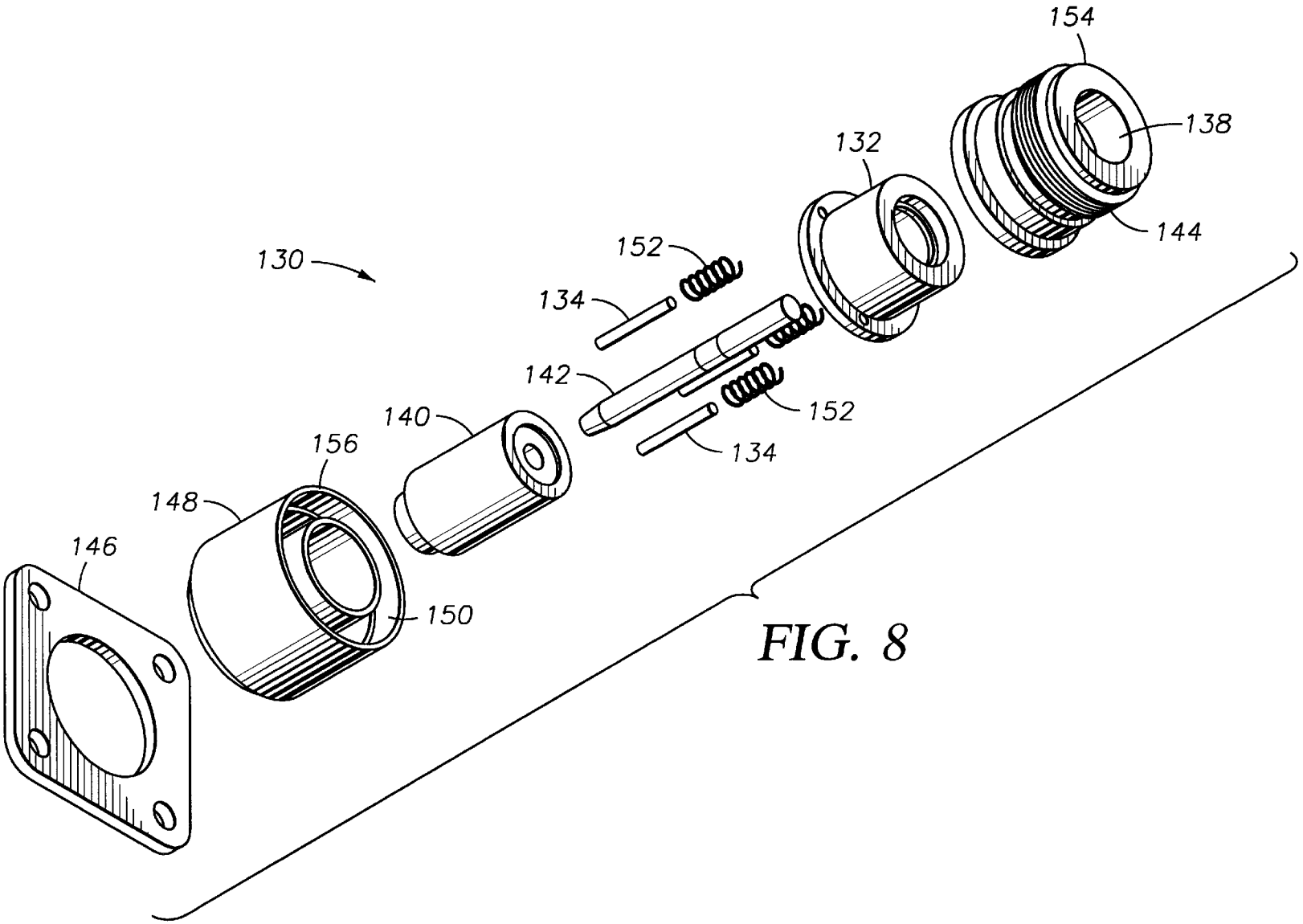
FIG. 8 is an assembly diagram for the female interlocked connector of FIG. 6.

FIG. 8 is an assembly diagram for the female interlocked connector of FIG. 6. The various components can be cast or machined. The insulator casing 140 and the metallic contact core 142 are inserted in the first section 148 of the connector body 136. The integral pins 134 are inserted in the cylindrical plunger 132 and capped by the springs 152 before the cylindrical plunger is placed in the annular channel 150 of the first section 148 of the connector body 136. The second section 154 of the connector body 136 holds the cylindrical plunger 132 in the annular channel 150 in the first section 148 and is secured by pressing or crimping an edge 156 of the first section 148 against the second section 154.

Figure 9:
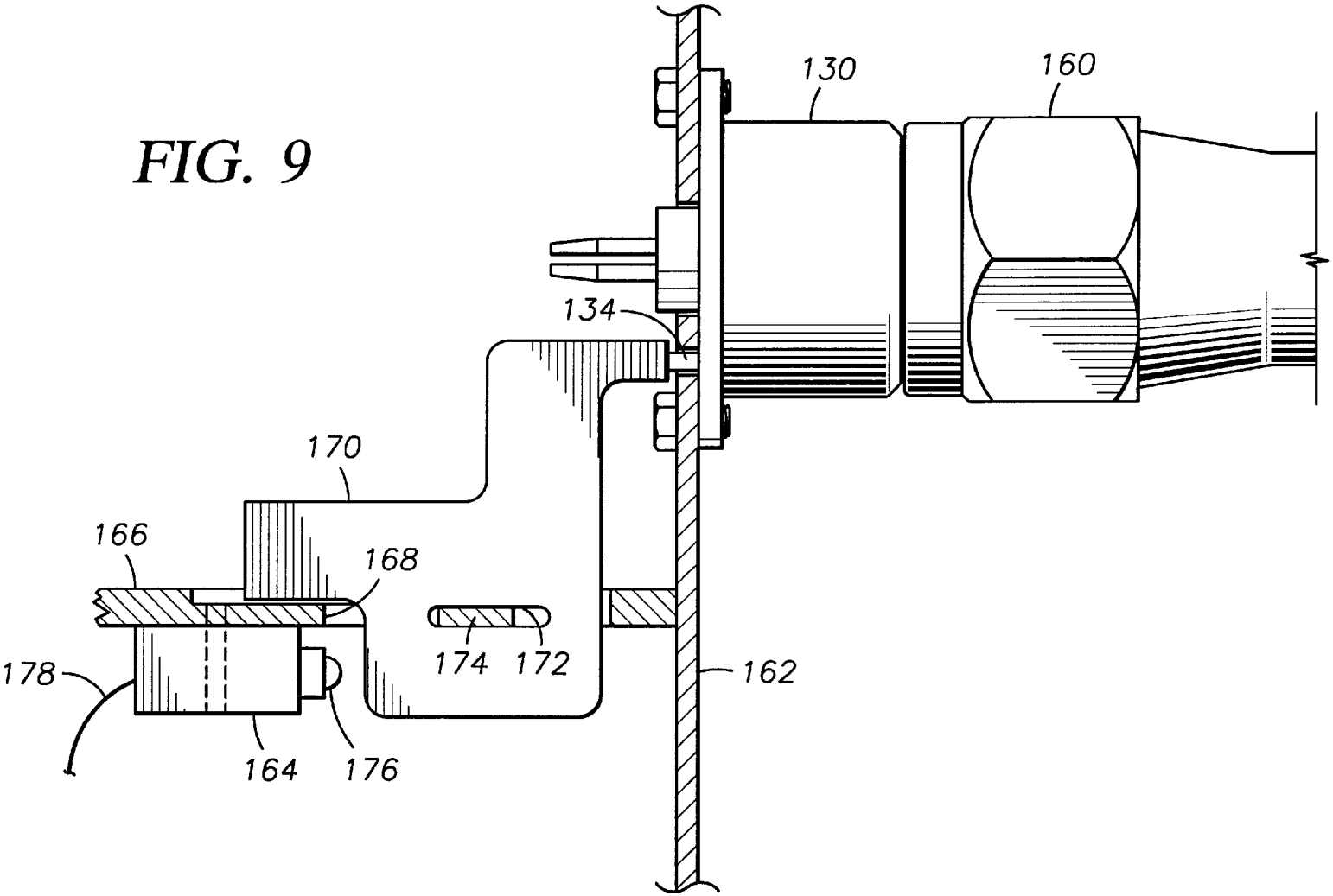
FIG. 9 is a schematic diagram of the female interlocked connector of FIG. 6 mounted on a surface adjacent an interlocked switch.

FIG. 9 is a schematic diagram of the female interlocked connector 130 of FIG. 6 in combination with a male RF connector 160 which can be identical to the male RF connector shown in FIGS. 6 and 7. The female interlocked connector 130 is mounted on an external surface of a housing 162 of a device, such as an RF match unit 18, which is typically used to match the impedance of an RF source to the impedance of a processing chamber. Bypassing of the female interlocked connector is avoided by having the integral pins 134 extend into the housing 161 of the device where additional interlock components are shielded from tampering. Preferred interlock components are represented in FIG. 9 and described in more detail below. However, it is contemplated that the integral pins 134 can be used in any manner to interlock a power source to a device.

Figure 3:
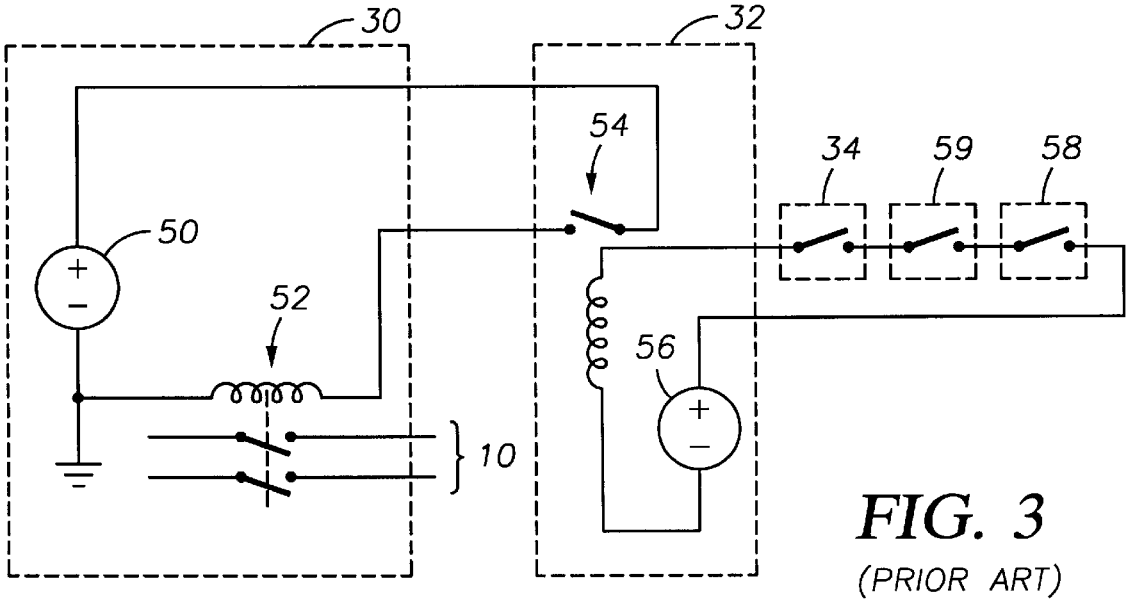
FIG. 3 (PRIOR ART)
FIG. 3 (prior art) is a schematic circuit diagram showing an interlocked switch which disables A/C power to a vacuum chamber as shown in FIG. 1.

Referring to FIG. 9, a microswitch 164, which can function as an interlocked switch 34 in FIGS. 1 and 3, is secured to a support plate 166 within the housing 162. The support plate 166 has a slot 168 for receiving a sliding actuator 170. The sliding actuator 170 has a slot 172 for receiving a flat pin 174 which is secured in a groove in the support plate 166 to limit movement of the sliding actuator 170 within the slot 168 in the support plate 166. The microswitch 164 has a spring loaded plunger 176 which closes the microswitch 164 when the pin 134 extends from the female connector 130 and slides the actuator 170 into the plunger 176. The spring loader plunger 176 opens the microswitch 164 when the pin 134 is retracted toward the female connector 130 allowing the plunger 176 to slide the actuator 170. The microswitch 164 is preferably a part of an interlock switch string 178, such as the switch string 32 shown for the interlocked switch 34 in FIG. 3. Only one pin 134 is needed to actuate one microswitch and additional pins, if any, can be trimmed to not extend from the female connector 130.

While the foregoing is directed to the preferred embodiment of the present invention, other and further embodiments of the invention may be devised without departing from the basic scope thereof. The scope of the invention is determined by the claims which follow.

What is claimed is:

1. An interlocked connector, comprising:

a connector body; and one or more integral interlock components disposed in a retraced position within the connector body and positioned to extend from the connector body to actuate a microswitch when the connector is mated.

2. The connector of claim 1, wherein the integral interlock components comprise an integral pin biased by a spring.

3. The connector of claim 2, wherein the connector is a female RF connector.

4. A female interlocked connector, comprising:

a connector body having a receiving chamber;

an integral pin biased in a retracted position within the connector body; and an actuator which moves the integral pin to an extended position to activate a microswitch when engaged by a male connector inserted into the receiving chamber.

5. The connector of claim 4, wherein the integral pin is biased by a spring.

6. The connector of claim 5, wherein the connector is an RF connector comprising an insulator casing positioned within the connector body and a contact core positioned within the insulator casing.

7. The connector of claim 6, wherein the actuator is a bent end of the integral pin which extends into the receiving chamber.

8. An interlock assembly, comprising:

a female interlocked connector comprising a connector body having a receiving chamber, an integral pin biased in a retracted position within the connector body, and a first actuator positioned between the integral pin and the receiving chamber to move the integral pin to an extended position in response to insertion of a male connector into the receiving chamber; and an interlocked switch comprising a second actuator positioned to depress a microswitch when the second actuator engages the integral pin in the extended position.

9. The assembly of claim 8, wherein the integral pin is biased by a spring.

10. The assembly of claim 9, wherein the first actuator is a bent end of the integral pin which extends into the receiving chamber.

11. The assembly of claim 10, wherein the connector is an RF connector comprising an insulator casing positioned within the connector body and a contact core positioned within the insulator casing.

12. The assembly of claim 11, wherein the female interlocked connector is mounted on an RF device.

13. The assembly of claim 12, wherein the RF device is an RF match unit.

14. An interlock assembly, comprising:

a connector comprising a connector body, an integral pin biased in a retracted position within the connector body, and a first actuator positioned to move the integral pin to an extended position when the connector is mated; and an interlocked switch comprising a second actuator positioned to depress a microswitch when the second actuator engages the integral pin in the extended position;

wherein the microswitch is part of an interlock switch string which interrupts a power source.

15. The assembly of claim 14, wherein the integral pin is biased by a spring.

16. The assembly of claim 15, wherein the first actuator is a bent end of the integral pin which extends into a receiving chamber in the connector body.

17. The assembly of claim 16, wherein the connector is an RF connector comprising an insulator casing positioned within the connector body and a contact core positioned within the insulator casing.

18. The assembly of claim 17, wherein the female connector is mounted on an RF device.

19. The assembly of claim 18, wherein the RF device is an RF match unit.

20. The assembly of claim 20, wherein the interlock switch string interrupts A/C power to the RF match unit.

* * * * *

UNITED STATES PATENT AND TRADEMARK OFFICE

CERTIFICATE OF CORRECTION

PATENT NO. : 5,879,176

DATED : March 9, 1999

INVENTOR(S) : Bradley O. Stimson

It is certified that error appears in the above-indentified patent and that said Letters Patent is hereby corrected as shown below:

In column 6, line 20, please replace "activate" with --actuate--.

Signed and Sealed this

Sixteenth Day of November, 1999

*Attest:*

*Attesting Officer*

Q. TODD DICKINSON

*Acting Commissioner of Patents and Trademarks*